US005845873A

United States Patent [19]

Millard

[11] Patent Number: 5,845,873

[45] Date of Patent: Dec. 8, 1998

[54] LARGE AIRCRAFT CRITICAL SURFACE COVERS

[76] Inventor: Carl W. Millard, Bay 1, Hangar 5 2450 Derry Road East, Mississauga, Ont., Canada, L5S 1B2

[21] Appl. No.: 610,858

[22] Filed: Mar. 5, 1996

[51] Int. Cl.[6] ..... B65D 85/68

[52] U.S. Cl. ..... 244/1 R; 150/166; 244/121

[58] Field of Search ..... 244/121, 134 R, 244/1 R; 150/166

[56] References Cited

U.S. PATENT DOCUMENTS

| | | | |
|---|---|---|---|
| 2,453,403 | 11/1948 | Bogardus | 244/1 R |
| 3,044,516 | 7/1962 | Stoll | 244/1 R |
| 4,598,883 | 7/1986 | Suter | 244/1 R |
| 4,606,516 | 8/1986 | Willison | 244/1 R |
| 5,114,098 | 5/1992 | Campbell | 244/121 |
| 5,143,321 | 9/1992 | Jackson | 244/121 |
| 5,255,875 | 10/1993 | Maglieri | 244/121 |
| 5,282,587 | 2/1994 | Rodyniuk et al. | 244/1 R |
| 5,340,055 | 8/1994 | Rodyniuk et al. | 244/1 R |

FOREIGN PATENT DOCUMENTS 2150677 6/1994 Canada .

*Primary Examiner*—V Lissi Mojica
*Attorney, Agent, or Firm*—Eugene J. A. Gierczak

[57] ABSTRACT

A cover and method for applying the cover unto the wing comprising a flexible material to cover the top surface of said wing, said material having a leading edge to cover the leading edge of said wing and a trailing edge to cover trailing edge of said wing; a first set of spaced apart attachment straps each said first attachment strap extending from said trailing edge of said cover under said wing for quick release attachment to said leading edge of said cover, so as to attach and quickly release said cover to said wing; a second set of spaced apart removal straps, each said straps extending from said leading edge of said cover over said wing for quick release attachment to said trailing edge of said cover so as to remove said cover from said leading edge to said trailing edge of said wing by pulling said removal straps.

12 Claims, 3 Drawing Sheets

LARGE AIRCRAFT CRITICAL SURFACE COVERS

BACKGROUND

It is common practice in the winter operations of large aircraft, before takeoff, usually at the gate or in a designated ramp area, to have their critical surfaces sprayed with de-icing fluid to remove frost, ice or snow adhering to them. This method results in:

A) fluid runoff into the ground and drains that is toxic to the environment;

B) complex procedures and equipment to collect, contain and dispose of the spent fluid;

C) substantial expenses to the aircraft operator and the taxpayer;

D) establishment of Holdover Times, often resulting in the aircraft having to return to the ramp for repeated spraying;

E) increased aircraft maintenance due to the "varnishing" effect of landing gear warning microswitches, and other important parts, which often happens when the de-icing fluid dries, particularly when the aircraft next lands at a tropical destination; and, F) potential for corrosion developing on skin laps, rivets, and exterior light units due to the incursion of the de-icing fluid.

It is an aspect of the invention to provide a cover for a wing comprising a flexible material to cover the top surface of said wing, said material having a leading edge to cover the leading edge of said wing and a trailing edge to cover the trailing edge of said wing; a set of spaced apart attachment straps each said attachment straps secured to said trailing edge of said flexible material and extending from said trailing edge of said cover under said wing for quick release attachment to said leading edge of said cover, so as to attach and quickly release said cover from said wing; a set of spaced apart removal straps, each said second straps secured to said leading edge of said flexible material and extending from said leading edge of said cover over said wing for quick release attachment to said trailing edge of said cover, so as to peel said cover from said leading edge to said trailing edge of said wing by pulling said removal straps.

It is a further aspect of the invention to provide a method of minimizing the accumulation of frost, ice or snow on the wing of a plane by utilizing flexible material comprising the steps of placing said material over the top surface of said wing, said material having a leading edge to cover the leading edge of said wing and a trailing edge to cover the trailing edge of said wing; securing one end of a set of spaced apart attachment straps to said trailing edge of said flexible material; then extending each of said set of spaced apart attachment straps from said trailing edge of said cover under said wing so as to attach each said attachment straps for quick release attachment to said leading edge of said cover so as to attach said cover to said wing; securing one end of a second set of removable straps to said leading edge of said cover; then extending each of a set of spaced apart removable straps from the leading edge of said cover over said wing for quick release attachment to said trailing edge of said cover so as to peel said cover from said leading edge to said trailing edge of said wing by pulling said removal straps.

SUMMARY

The aforementioned difficulties can be practically eliminated by the use of critical surface covers, in lieu of spraying in most cases. The covers will prevent hoar frost from forming on aircraft parked outside overnight, and, will keep most types of below-freezing precipitation separated from the critical surfaces, until the aircraft is ready for takeoff. A key feature to my invention is that the aircraft is protected during the taxi-out to the runway, so that long taxies and delays do not compromise the critical surfaces' safe condition for flight, as does now occur using spray at the gate or de-icing booth. I see, as the greatest advantage of the covers, that the pilot will be free of having to make "last chance" or "last minute" decisions to Go or No Go when operating in below-freezing precipitation conditions, which history has shown to result in several crashes and major loss of lives.

The covers of this invention are designed to "roll on" spanwise, thus permitting their donning during windy condition; and to "peel off" chordwise, thus permitting removal on vortex generator 30 equipped wings without damage to the cover; and, through a system of straps to be able to be removed, in a wind, by ground personnel without the aid of raised platforms, when the aircraft is at the button of the departing runway.

BRIEF DESCRIPTION OF THE DRAWINGS

Sketches on the accompanying sheets portray the cover and its parts.

DESCRIPTION

Figure 1:
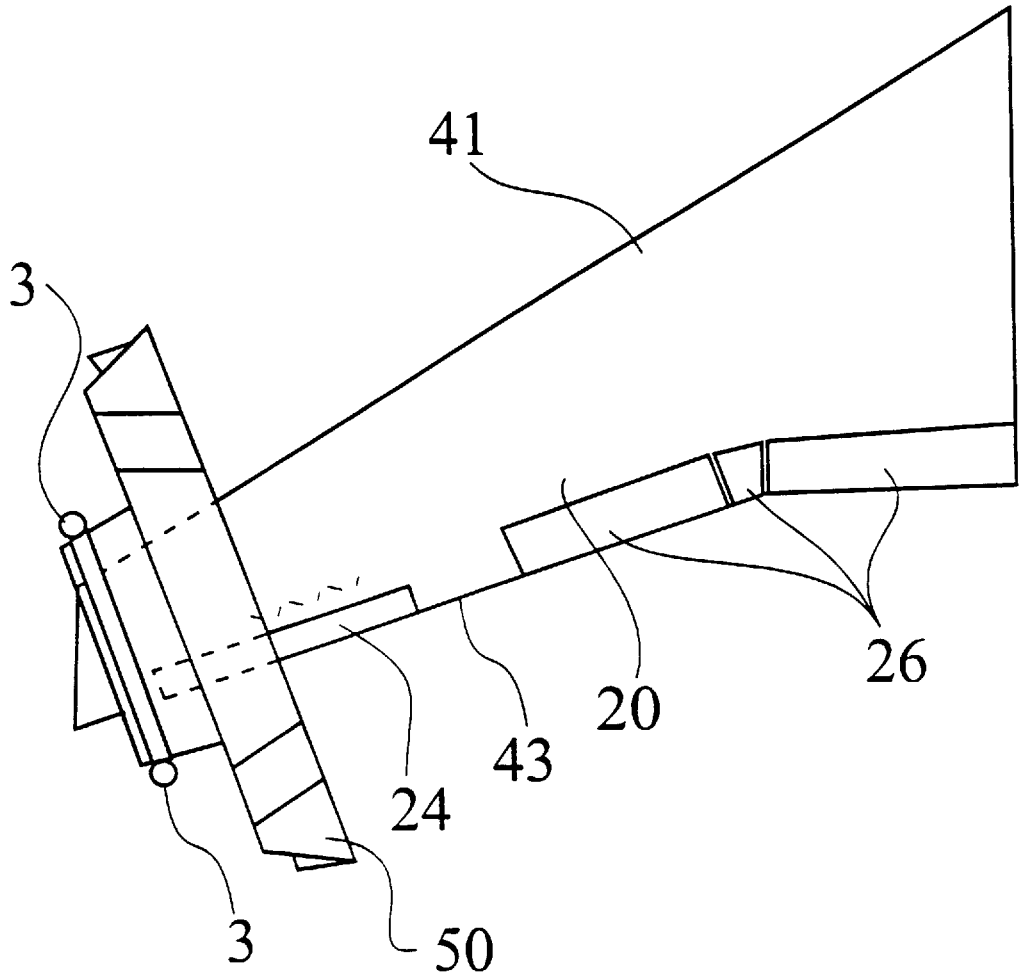
FIG. 1 is a top plan view of a wing showing the cover just prior to application.
Figure 2:
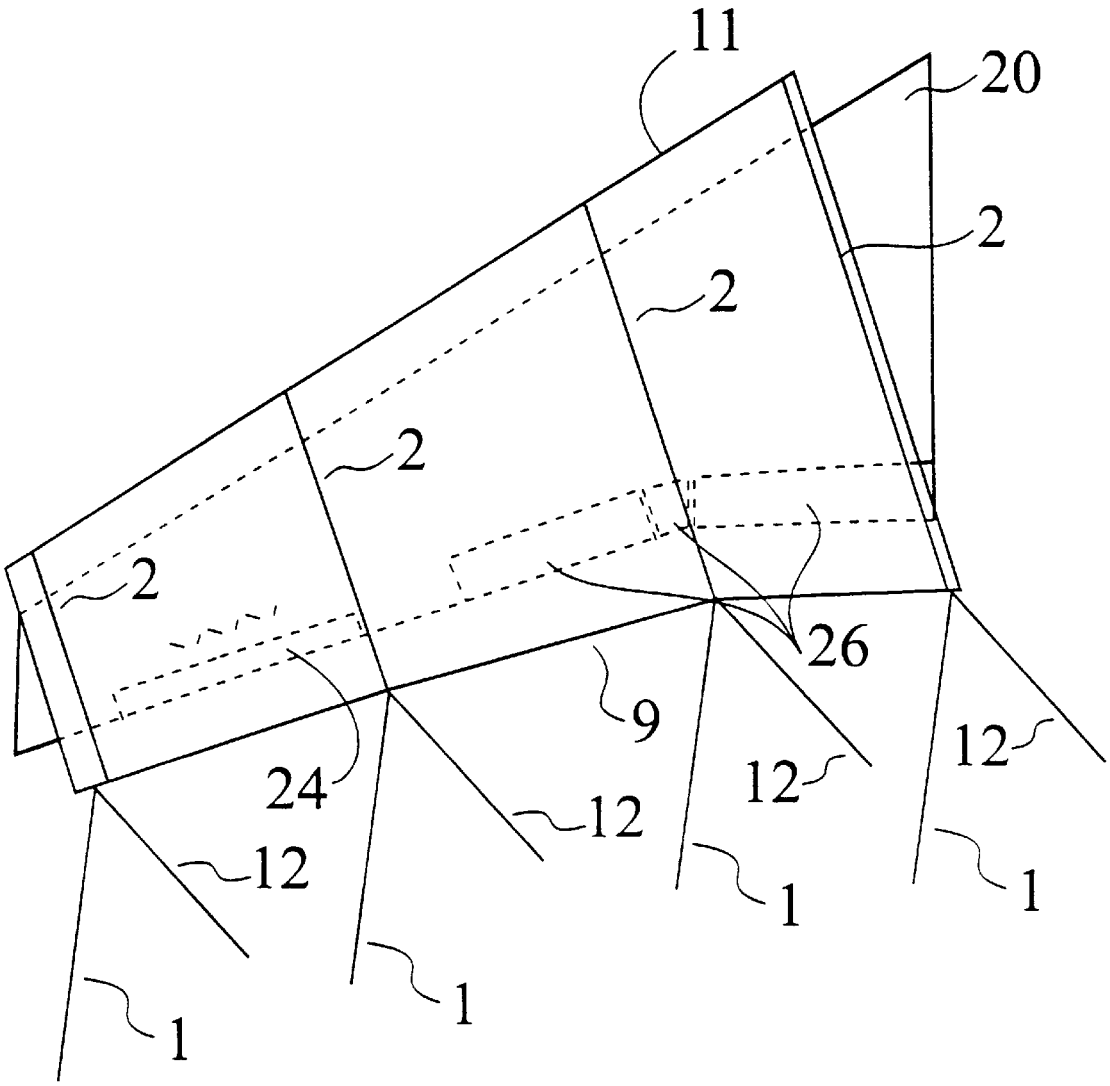
FIG. 2 is a top plan view of the wing showing the cover applied unto the wing.
Figure 3A:
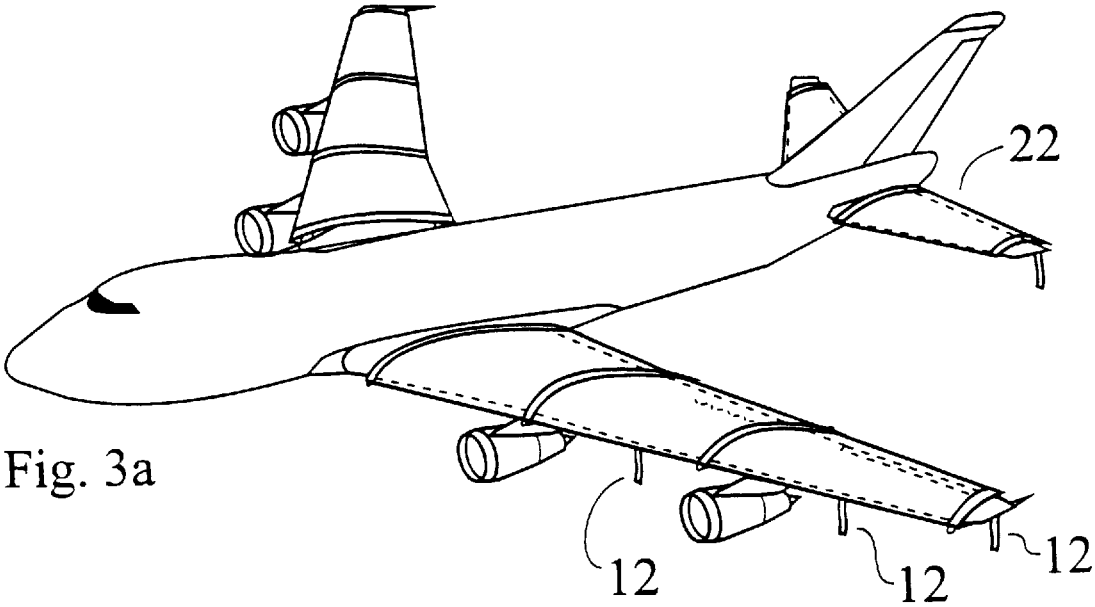
FIGS. 3*a* and 3*b* illustrate the invention in perspective view.
Figure 3B:
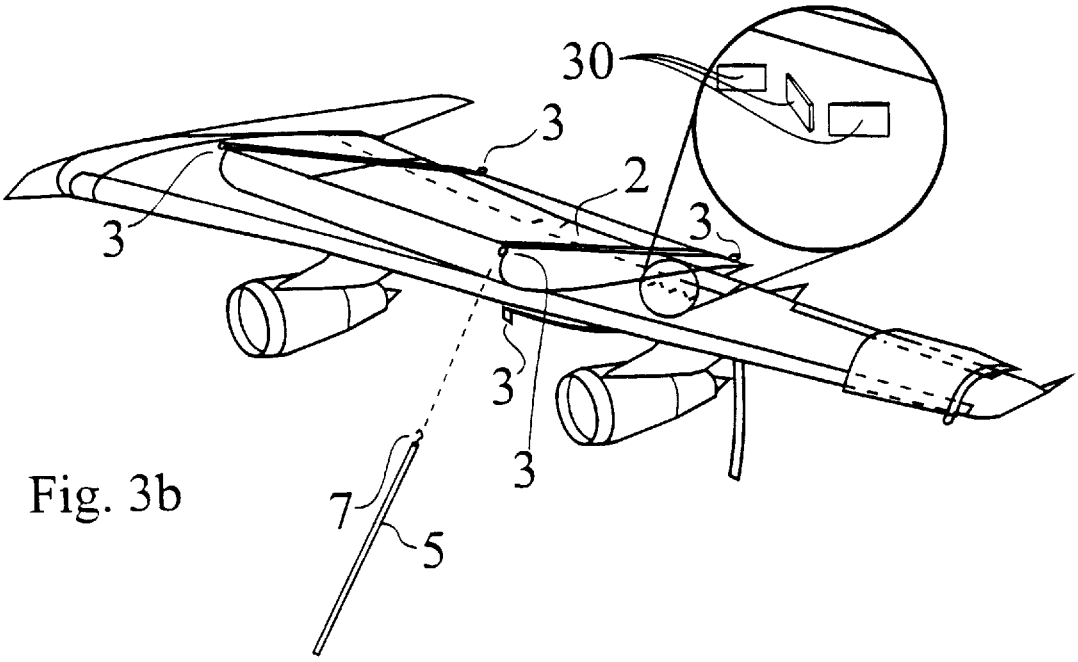

The covers 50 for both wing and tailplane are made of flexible material and cover the top of the surface as well as extending around the leading 41 and trailing edge 43 for a short distance. An adequate number of Attach Straps (1) lead from the trailing edge 9 of the cover, under the wing or tailplane, to attach to the leading edge 11 by means of a quick-release 3. An adequate number of Removal Straps (2) lead from the leading edge of the cover, over the wing or tailplane, with the free end attached to the trailing edge by a quick-release, (3), and have an extension 12 of sufficient length to be operated by personnel on the ground. The releases may be operated by personnel on ground level by means of a pole 5 and hook 7 fashioned for that use.

The covers are to be donned when an aircraft on the ground will be subjected to hoar frost or below-freezing precipitation.

To don, place the rolled-up prepacked cover, chordwise, at root or tip, and unroll it until the first Attach Strap (1) is exposed, and then attach it to the cover's leading edge cuff. Continue in stages of unrolling and attaching, until completed. Note that during packing of the cover, the Removal Straps (2) will have been positioned in readiness for the removal phase.

To remove, the aircraft should preferably be parked into wind, then Attach Straps (1) and Romoval Straps (2) released. The Removal Strap (2) extension ends may now be pulled upon to peel off the cover from fore to aft. The wing can include vortex generators (4) as shown in FIG. 1.

I claim:

1. A cover for a wing comprising:

(a) a flexible material to cover the top surface of said wing, said material having a leading edge to cover the leading edge of said wing and a trailing edge to cover the trailing edge of said wing;

(b) a set of spaced apart attachment straps each said attachment straps secured to said trailing edge of said flexible material and extending from said trailing edge of said cover under said wing for quick release attachment to said leading edge of said cover, so as to attach and quickly release said cover from said wing;

(c) a set of spaced apart removal straps, each said second straps secured to said leading edge of said flexible material and extending from said leading edge of said cover over said wing for quick release attachment to said trailing edge of said cover, so as to peel said cover from said leading edge to said trailing edge of said wing by pulling said removal straps.

2. The cover as claimed in claim 1 adapted to roll unto said wing.

3. The cover as claimed in claim 2 wherein said wing includes vortex generators.

4. The cover as claimed in claim 3 wherein each said removal straps includes an extension at said trailing edge for pulling said cover from said leading edge to said trailing edge of said wing.

5. The cover as claimed in claim 4 wherein each said removal straps are adapted to be removed by a pole.

6. The cover as claimed in claim 4 wherein said wing comprises a tailplane.

7. The cover as claimed in claim 4 wherein said wing includes an aileron.

8. The cover as claimed in claim 4 wherein said wing includes flaps.

9. A method of minimizing the accumulation of frost, ice or snow on the wing of a plane by utilizing flexible material comprising the steps of:

(a) placing said material over the top surface of said wing, said material having a leading edge to cover the leading edge of said wing and a trailing edge to cover the trailing edge of said wing;

(b) securing one end of a set of spaced apart attachment straps to said trailing edge of said flexible material;

(c) then extending each of said set of spaced apart attachment straps from said trailing edge of said cover under said wing so as to attach each said attachment straps for quick release attachment to said leading edge of said cover so as to attach said cover to said wing;

(d) securing one end of a second set of removable straps to said leading edge of said cover;

(d) then extending each of a set of spaced apart removable straps from the leading edge of said cover over said wing for quick release attachment to said trailing edge of said cover so as to peel said cover from said leading edge to said trailing edge of said wing by pulling said removal straps.

10. The method as claimed in claim 9 wherein said cover is rolled chordwise on said wing.

11. The method as claimed in claim 9 wherein said cover is peeled off from said wing by pulling said removal straps so that said leading edge of said cover is moved over said cover from said leading edge to said trailing edge.

12. The method as claimed in claim 11 wherein said attachment straps are released from said leading edge of said cover prior to removing said removal straps from said leading edge to said trailing edge of said wing.

* * * * *